United States Patent [19]

Schaer et al.

[11] 3,957,452

[45] May 18, 1976

[54] PROCEDURE FOR COPPER PLATING ALUMINIUM WIRE AND PRODUCT THEREOF

[75] Inventors: Glenn R. Schaer, Columbus; Richard W. Sexton, Hilliard, both of Ohio

[73] Assignee: General Cable Corporation, Greenwich, Conn.

[22] Filed: Dec. 12, 1974

[21] Appl. No.: 531,916

[52] U.S. Cl. ..... 29/183.5; 29/197; 204/27; 204/28; 204/38 B; 204/52 R; 204/206; 204/207; 204/238; 204/276

[51] Int. Cl.[2] ..... B23P 3/00; C25D 5/10; C25D 5/30; C25D 7/06

[58] Field of Search ..... 29/197, 183.5; 204/38 B, 27, 28, 206, 207, 238, 276

[56] References Cited

UNITED STATES PATENTS

| | | | |
|---|---|---|---|
| 1,405,534 | 2/1922 | Merritt | 29/197 |
| 2,676,916 | 4/1954 | Zelley | 204/38 B X |
| 2,995,814 | 8/1961 | Chamness | 29/197 X |
| 3,108,006 | 10/1963 | Kenedi et al. | 204/38 B X |

OTHER PUBLICATIONS

A. Kenneth Graham, "Electroplating Engineering Handbook", pp. 722–724, (1962).

*Primary Examiner*—G. L. Kaplan
*Attorney, Agent, or Firm*—Sandoe, Hopgood & Calimafde

[57] ABSTRACT

This method of copper plating aluminum and aluminum alloy wire or strip applies an adherent and ductile plating while the wire is moving rapidly and continuously through the plating apparatus. An improved chemical zincating step followed by a copper pyrophosphate strike plating, within critical thickness limits, reduces the plating time and makes practical plating of the wire while moving at speeds of about 100 feet per minute or more in relation to the processing solution.

16 Claims, 6 Drawing Figures

PROCEDURE FOR COPPER PLATING ALUMINIUM WIRE AND PRODUCT THEREOF

BACKGROUND AND SUMMARY OF THE INVENTION

This invention will be described as applied to the aluminum wire. The term "aluminum" is used herein to designate pure aluminum, EC grade, other major grades of aluminum containing normal amounts of impurities, and alloys of aluminum in which aluminum is the major ingredient. It will be understood that the invention can be used for elongated aluminum stock other then wire, for example, aluminum strip.

Aluminum wire clad with copper is the equivalent of solid copper with respect to maintaining a low electrical contact resistance and is acceptable in most applications. A low-cost commercial method for applying a copper cladding can provide a cost savings because aluminum conductors cost less per unit of current carrying capacity than solid copper conductors. Electroplating is a commercial method for applying copper coating on steel wire and should be equally successful for aluminum. However, other investigators have been unable to obtain quality copper electroplates on moving aluminum wire. Either the adherence or ductility of the copper deposit was poor, or the processing time was too long.

Most procedures for plating on aluminum were developed for conventional tank plating where there is relatively little agitation or flow of solution over the aluminum surfaces. Plating on moving wire imposes different conditions because there is relative motion between the aluminum and the processing solutions. For wire plating this motion can exceed 100 ft per minute.

This invention provides a method and apparatus for applying a plating of adherent ductile copper on aluminum wire which is traveling continuously through the plating apparatus. The combination of successive steps of this invention obtains the desired plating rapidly so that the process can be carried out with the wire traveling at high speed without making the apparatus excessive in length. After the preliminary cleaning and passivating, the invention passes the wire through a zincating step followed by a copper strike plating. The amount of copper applied in the strike plating has been found to have critical limits which are important to the success of the subsequent steps of the process. The thickness of the copper plating is built up by subsequent plating in a copper fluoborate bath.

The certain chemical compositions of the baths used for different steps of the process have been found much more advantageous than others.

Other objects, features and advantages of the invention will appear or be pointed out as the description proceeds.

BRIEF DESCRIPTION OF DRAWING

In the drawing, forming a part hereof, in which like reference characters indicate corresponding parts in all the views.

DESCRIPTION OF PREFERRED EMBODIMENT

Figure 1:
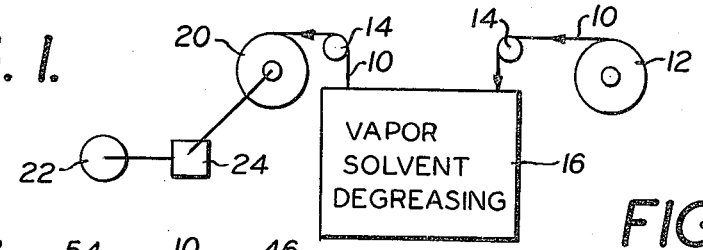
FIG. 1 is a diagrammatic illustration of the first step of the method of this invention.

FIG. 1 shows wire 10 which is withdrawn from a supply reel 12 and which passes over a guide pulley 14 into a treating tank 16. This treating tank 16 is a degreasing station in which the wire passes through hot vapor before being immersed in boiling trichloroethylene. The wire moves from the hot solvent back into the vapor and subsequently into cool trichlorethylene at about 90° F; and finally passes up through condensing vapors of the trichlorethylene for final cleaning. The wire 10 leaves the degreasing unit by passing over a guide pulley 14 beyond which the wire is wound on a takeup reel 20 rotated by a motor 22 through motion transmitting connections including a speed reduction unit 24.

Figure 2A:
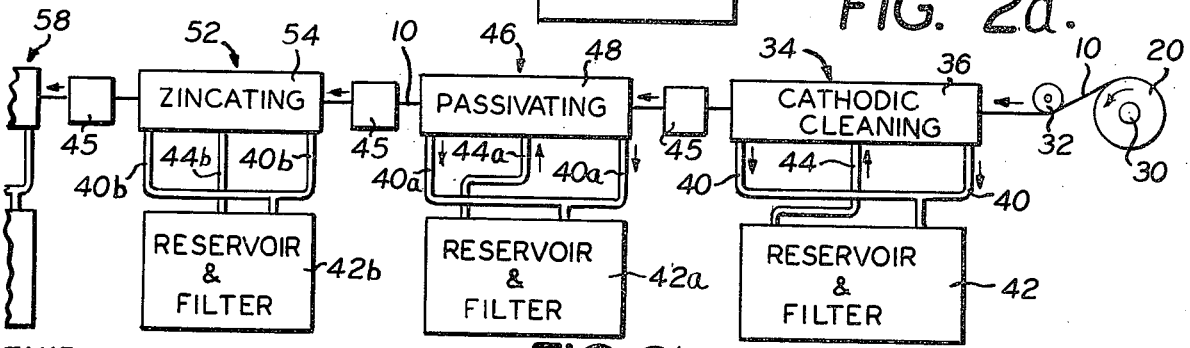
FIGS. 2*a* and 2*b* are diagrammatic illustrations of the plating line through which the wire passes from a payoff reel, through successive baths and rinses to a takeup reel on which the plated wire is wound.
Figure 2B:
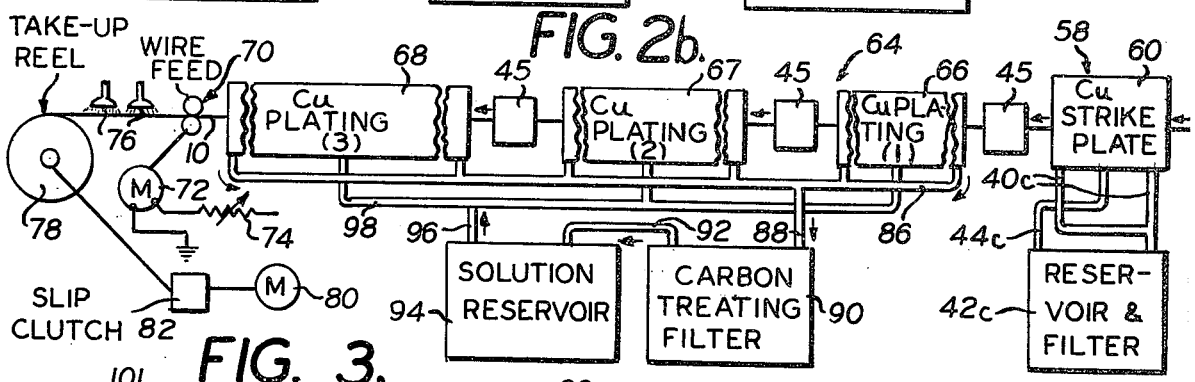

The reel 20 is then placed on an axle 30 (FIG. 2*a*) at one end of the plating line; and wire 10 is drawn across a guide roll 32 to another cleaning station 34. This cleaning station 34 includes a tank 36 in which the wire 10 is subjected to cathodic cleaning. The tank preferably contains a solution having 200 g/l of sodium hydroxide and 20 g/l of trisodium phosphate operated at 140° F with a current density of 270 amp/sq. ft. (cathodic). The lengths of the tank 36 is correlated with the wire speed so that the wire is in the tank 36 for approximately 30 seconds.

The tank 36 has outlets 40 which drain solution into a reservoir 42. The solution is pumped back to the tank 36 through a supply line 44. The internal construction of the tank 36 will be explained in connection with FIGS. 3–5.

Beyond the tank 36, the wire 10 passes through a rinsing station 45 to a passivating station 46 which includes a tank 48 containing nitric acid. This passivating step is entirely chemical and no current is used.

Nitric acid from the tank 48 drains through outlet lines 40*a* to a reservoir 42*a* from which the nitric acid is pumped back to the tank 48 thru supply line 44*a*.

Beyond the passivating station 46 the wire 10 passes through another rinsing station 45 and then into a zincating station 52 which includes a tank 54 containing a basic zincate solution consisting of 115–120 g/l of sodium hydroxide plus either 20 g/l of zinc oxide or 40 g/l of zinc sulfate. To this basic solution copper, nickel and cyanide additions were found essential to obtain good adhesion. Examples of such additions are shown in Table 1 below.

Table 1

| Solution Designation | Metal | Salt | Quantity |
|---|---|---|---|
| 3(a) | Copper | Cuprous cyanide | 1.0 g/l |
| | Nickel | Nickel cyanide | 1.0 g/l |
| | | Sodium cyanide | 5.0 g/l |
| 3(k) | Cobalt | Cobaltous sulfate | 0.05 g/l |
| 3(e) | Cobalt | Cobaltous sulfate | Saturated |

The zincating step is particularly valuable for promoting good adhesion on EC-grade aluminum wire. This zincate activation step was found to be satisfactory with single immersion coating as opposed to double immersion coating in which the first zinc coating is dissolved in nitric acid and the aluminum is recoated by a second immersion.

An example of a zincate immersion bath is one which comprises

| | |
|---|---|
| sodium hydroxide | 120g/l |
| zinc oxide | 20g/l |
| sodium cyanide | 5.0g/l |
| cuprous cyanide | 1.0g/l |
| nickelous cyanide | 1.0g/l |

and is operated at about 105°F.

The zincate activation at the station 52 provided a continuous and adherent coating suitable for electroplating with copper from an alkaline strike solution at the next treating station 58.

The tank 54 has outlet lines 40*b* through which solution from the tank 54 flows to a reservoir 42*b*. The solution is pumped back to the tank 54 through a supply line 44*b*.

The next treating station along the plating line is a copper strike plating station 58 at which the wire 10 passes through a tank 60 in which the wire is plated from a copper pyrophosphate bath in the tank 60, the wire 10 is plated with a current density of approximately 220 amp/sq. ft. for a period of 10 seconds. The length of the tank 60 is coordinated with the intended speed of travel of the wire 10 so that the wire is in the tank 60 for approximately 10 seconds.

At the strike plating station 58, very thin deposits of bronze, brass, or copper from cyanide solutions can be applied with good results with respect to adhesion and ductility. Suitable conditions for these bronze, brass and copper deposits which can be used in place of the copper pyrophosphate are shown in Table 2.

Table 2

| Solution Designation | Primary Constituent | Optimum Current Density, amp/sq ft | Time Required, seconds |
|---|---|---|---|
| 5(h) copper | Cuprous cyanide | 90 | 120 |
| 5(i) bronze | Cuprous cyanide<br>Potassium stannate | 100 | 11 |
| 5(g) brass | Cuprous cyanide<br>Zinc cyanide | 90 | 25 |

In practice, copper pyrophosphate striking appears to afford the best coverage and poses less of a waste disposal problem than cyanide strikes. The detailed information on the pyrophosphate and alternate striking solutions for the station 58 are given in Table 3.

Table 3

| Copper Strike Plating Bath | |
|---|---|
| (1) Bath 4(a) | |
| cuprous cyanide | 41 g/l |
| sodium carbonate | 45 g/l |
| Rochelle salts | 60 g/l |
| sodium cyanide | 49.5 g/l |
| free NaCN | 17 g/l ± 2 g/l |
| temperature | 125 ± 5 F |
| current density | 80 amp/sq ft |
| pH | 10.2 to 10.5 electro- |
| anodes - copper | metrically |
| (3) Bath 4(c) | |
| copper pyrophosphate | 94 g/l |
| potassium pyrophosphate | 340 g/l |
| ammonium hydroxide | 4–5 ml/l |
| potassium nitrate | 15 g/l |
| temperature | 130 ± 2 F |
| current density | 220 amp/sq ft |

Table 3-continued

| Copper Strike Plating Bath | |
|---|---|
| pH | 8.2 to 8.5 elec- |
| anodes - copper | trometrically |
| (4) Bath 5(g) | |
| cuprous cyanide | 75 g/l |
| zinc cyanide | 30 g/l |
| sodium cyanide | 150 g/l |
| sodium hydroxide | 4.5 g/l |
| sodium carbonate | 15 g/l |
| free NaCN | 41 g/l |
| temperature | 145 ± 5 F |
| current density | 80 amp/sq ft |
| anodes | 70 – 30 brass |
| (5) Bath 5(i) | |
| cuprous cyanide | 30 g/l |
| potassium stannate | 37.5 g/l |
| potassium cyanide | 67.5 g/l |
| potassium hydroxide | 11.3 g/l |
| Rochelle salts | 45 g/l |
| free KCN | 21 g/l ± 2 g/l |
| temperature | 155 ± 5 F |
| current density | 100 amp/sq ft |
| anodes | copper |

In the preferred embodiment of this invention, the copper strike plating in the tank 60 is done in approximately 60 seconds or less. There appears to be a critical thickness for the first copper plating, that is, the strike plating done at the station 58. When thicknesses of plated copper were less than 0.03 mil, poor adhesion resulted in the final product. When thicknesses were significantly over 0.06 mil, the deposit cracked when the plated wire was bent. The same critical thickness range was found when the copper strike plating bath was a pyrophosphate, a cyanide, a brass (cyanide type) or a bronze (cyanide type) bath.

The tank 60 at station 58 has outlet lines 40*c* through which the solution drains from the tank 60 into a reservoir 42*c*. The solution is pumped from the reservoir 42*c* back through a supply pipe 44*c* to the tank 60.

After passing from the tank 60, the wire 10 passes through the main copper plating tanks from which copper is plated on the wire in an acid bath.

This main copper plating station is designated by the reference character 64 and it contains three tanks 66, 67 and 68 arranged in series so that the wire 10 passes from one tank to the other. Electrical contacts 66*c* and 67*c* are preferably located between the successive tanks 66, 67, and 68. Rinsing stations 45 are preferably located between the successive tanks 66, 67 and 68. Beyond the last plating tank 68 the wire 10 is advanced by feed rolls of a wire feed capstan 70 driven by a motor 72 which has a speed control indicated diagrammatically and designated by the reference character 74.

A hot water rinse 76 is applied to the wire 10 beyond the capstan 70 and the heat of the water causes the wire to dry rapidly so that it is dry as it wraps on a takeup reel 78 which is driven by a motor 80 through a slip clutch 82.

It is an important function of the strike plating station 58, before the wire 10 enters the main plating station 64, that the copper plating deposited at station 58 be an adherent, pore-free and ductile coating over the zinc alloy displacement coating applied to the wire at the station 52. If pores in the strike plating are not avoided, the underlying zinc and aluminum are attacked chemically in the solution in the main plating tanks 66–68. Such chemical attack if present, induces pits in the thicker copper overlay and when the final wire is bent, cracks develop at pit sites. Experience indicates that a copper pyrophosphate bath in the copper strike station 58 provides the best insurance against pores in the copper plating applied as the strike plate.

The tanks 66, 67 and 68 have outlet lines connected with a header 86 which drains through piping 88 into a carbon treating filter tank 90. Solution is pumped from the tank 90 through connecting piping 92 to a solution reservoir 94 and from this solution reservoir through a supply line 96 which connects with a header 98 that communicates with inlet openings in all of the tanks 66, 67 and 68.

A copper fluoborate bath is used for plating the final copper coating in the tanks 66–68 at the main plating station 64. Smooth ductile deposits are obtained when the free fluoboric acid content is from 2 to 60 g/l. With an acid concentration of 15 g/l, smoother deposits are obtained than at lower concentrations. Organic impurities, which are known to decrease the ductility of copper deposits, are removed by activated carbon in the filter tank 90.

Copper fluoborate is the best known solution for plating wire because it produces smoother ductile deposits at thicknesses above 2 mils. Copper from the fluoborate solution is deposited with this invention at current densities ranging from 300 to 1,000 amp/sq. ft. when wire speed relative to the solution is 100 feet per minute.

The final thickness of the copper plating should be greater than 3% of the cross sectional area because thinner coating causes occurrence of cracks when the wire is bent. 7% or more gives better assurance against cracking.

Copper plating equal to 5% of the cross sectional area of the wire can be applied in 110 seconds from the following plating bath with the current densities specified.

| | |
|---|---|
| cupric fluoborate | 440 g/l |
| copper as metal | 117 g/l |
| boric acid | 30 g/l |
| free fluoboric acid | 20 to 30 g/l |
| temperature | 150 ± 5 F |
| current density | 600 to 750 amp/sq ft |
| pH | 0.3 to 0.5 electrometrically |
| specific gravity | 1.29 to 1.33 |
| carbon treatment | continuous |

Other examples of suitable plating baths and operating conditions for the final plating station 64 are as follows:

| | |
|---|---|
| Bath 6(a) | |
| cupric fluoborate | 470 g/l |
| copper as metal | 125 g/l |
| boric acid | 30 g/l |
| free fluoboric acid | 2 to 30 g/l |
| temperature | 140 ± 5 F |
| current density | 350 to 950 amp/sq ft |
| pH | 0.3 to 0.9 electrometrically |
| specific gravity | 1.352 at 75 F |
| carbon treatment | Darco S-51, 15 g/l * |
| Bath 6(b) | |
| cupric fluoborate | 440 g/l |
| copper as metal | 117 g/l |
| boric acid | 30 g/l |
| free fluoboric acid | 15 to 30 g/l |
| temperature | 150 F ± 2 F |
| current density | 600 amp/sq ft |
| pH | 0.3 to 0.5 electrometrically |
| specific gravity | 1.323 at 75 F |

-continued

| | |
|---|---|
| carbon treatment | Darco G-60, 15 g/l * |

* Darco S-51 and Darco G-60 are trademarks of Atlas Chemical Ind. Inc., New Murphy Road, Wilmington, Delaware 19899.

The reason for having three tanks 66, 67 and 68 at the final plating station 64 is to increase the time that the wire is in the final plating solution. If the thickness of the plating is to be a minimum, then the tank 66 is operated but the tanks 67 and 68 are not operated, and the wire passes through these second tanks without acquiring any additional plating. These tanks 66, 67 and 68 are preferably of different lengths so that by choosing which tank will be used to apply plating to the wire, the length of time can be varied in proportion to the thickness of the plating desired, it being understood that the wire speed may be dictated by the effects to be produced at the other treating stations. For a thicker plating than can be obtained by passing the wires through the longest tank 68, two or more of the tanks 66–68 can be used at the same time and by choosing which combination of these tanks will be used together still more control of the plating time can be obtained. Also the thickness of the plating can be controlled by varying the current density.

Figure 3:
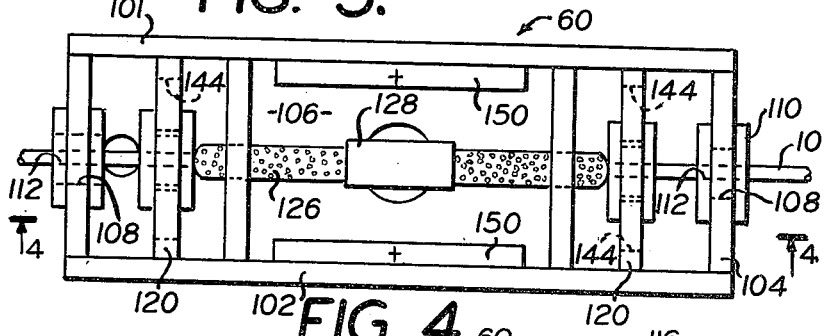
FIG. 3 is a top plan view illustrating diagrammatically and on a larger scale one of the plating stations shown in FIGS. 2*a* and 2*b;*
Figure 4:
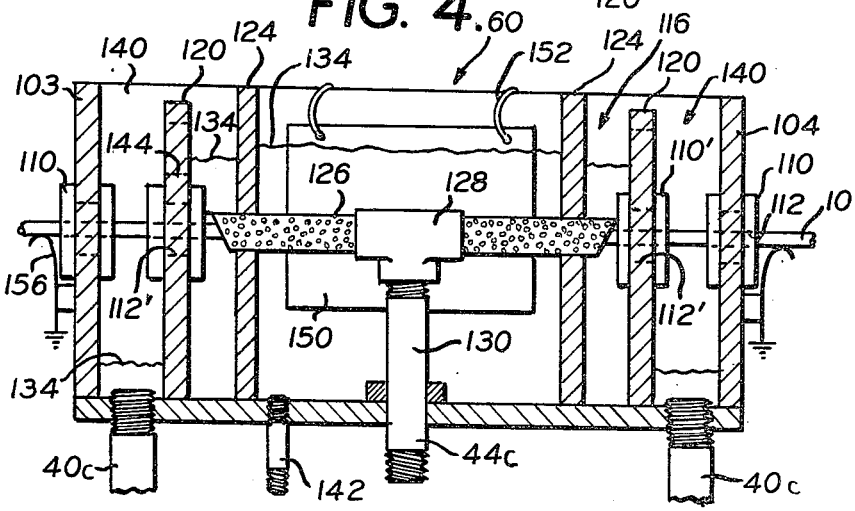
FIG. 4 is a sectional view taken on the line 4—4 of FIG. 3.
Figure 5:
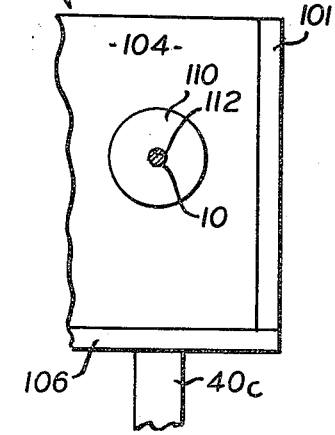
FIG. 5 is a fragmentary end view of the apparatus shown in FIGS. 3 and 4.

FIGS. 3–5 show one of the tanks through which the wire 10 passes at a treating station. The tank shown is the tank 60, but it will be understood that all of the tanks can be of similar construction but of different lengths depending upon the relative length of time that the wire is to be within that tank during its travel down the plating line. The anodes shown in FIGS. 3–5 and the provision for passing current through the wire will not be present in any tank in which no electric current is used, such as in the tank 48 and 54.

The tank 60 has side walls 101 and 1:2 which join with end walls 103 and 104 to form the tank enclosure. This enclosure has a bottom 106, but the top can be open if desired.

There are openings 108 in each end wall 103 and 104; and these openings have rubber stopper seals 110 in them with a small opening 112 through each of the stopper seals 110 for passage of the wire 10 into the tank 60 through the end wall 104 and out of the tank through the other end wall 103.

The interior of the tank 60 is divided into an inner compartment 116 which is defined by partition walls 120 extending across the tank from the side wall 101 to the side wall 102 and by the portions of these side walls 101 and 102 which are between the partitions 120. This inner compartment 116 has other partition walls 124 extending across the space between the side walls 101 and 102 and there is a perforated tube 126 which extends at its opposite ends through openings in the partition walls 124; but this tube 126 does not extend all the way to the walls 120. There is a tee fitting 128 located at a mid region of the tube 126, and piping 130 extends downward from the tee fitting 128 to the bottom 106 of the tank 60. This piping 130 forms part of the supply line 44*c*, previously described.

The partition walls 120 have openings 112' in alignment with the openings 112 of the end walls, and have rubber stopper seals 110' with center openings through which the wire 10 passes.

Plating solution 134 flows into the tank 60 through the piping 130 and is distributed by the tube 126 into the inner compartment 116. The level of the solution 134 is somewhat higher between the partitions 124 than it is between the partitions 120 and 124 because some solution leaks through the clearance around the wire 10 and the rubber stopper seal 110'.

There is an outer compartment 140 between the partition 120 and the end wall 104, and there is a similar outer compartment 140 between the end wall 103 and the partition wall 120. Any of the plating bath 134 which leaks into the outer compartments 140 does not accumulate to any substantial level above the bottom 106 because the plating solution or bath 134 runs out of the tank 60 through the outlet lines 40*c* to a filter and reservoir as already explained. A drain fitting 142 provides for drainage of liquid from the inner compartment when desired. Overflow openings 144 in the partitions 120 permit escape of liquid which rises above the level of the openings 144 so that a substantial flow of solution can be maintained from the supply line 44*c* through the tank 60 and back to the outlet lines 40*c*.

Copper anodes 150 are supported by the walls 101 and 102 on opposite sides of the tank 60 and these anodes 150 are connected with a current supplied by conductors 152 (shown in FIG. 4). The tube 126 is perforated to permit the copper to be deposited on the wire 10 as the wire passes through the tube 126.

The tank 60 is preferably fabricated from polyvinyl chloride sheets, or made from other material which will not be attacked by any of the solutions. The tube 126 is preferably made of polypropylene which is not attacked by any of the solutions, but a variety of other materials can be used. The wire 10 can be grounded in any conventional way as by brushes 156. The electrical contact to the wire 10 can be made by conventional methods such as brushes or rotating contacts to induce the direct current needed for the electrolytic process.

The preferred embodiment and some modifications have been described, but changes in modifications can be made and some features can be used in different combinations without departing from the invention as defined in the claims.

What is claimed is:

1. The method of copper plating lengths of aluminum stock which comprises subjecting the aluminum stock to a zincate activation step, then electro-plating the stock with a strike plating of metal from the group consisting of copper, brass, and bronze in an alkaline bath and to a thickness between about 0.03 to 0.06 mils, and then electroplating the material with additional copper in an acid bath, the thickness of the additional copper plating being substantially greater than the strike plating.

2. The method described in claim 1 characterized by the aluminum stock being a wire, initially cleaning the wire, treating it with the zincating bath, and applying the copper plating while the wire is in motion through the cleaning, zincating, and plating solutions.

3. The method described in claim 2 characterized by the zincate activation step including one, and only one, immersion of the material in a bath from which a coating of zinc is deposited on the aluminum.

4. The method described in claim 2 characterized by the zincate activation step including an immersion of the material in a bath containing sodium hydroxide, zinc oxide, and some other metal introduced into the solution from a group consisting of copper, nickel and cobalt.

5. The method described in claim 4 characterized by the other metal introduced into the bath being provided by a salt selected from the group consisting of cuprous cyanide, nickel cyanide, nickelous sulfate, and cobaltous sulfate.

6. The method described in claim 2 characterized by the material plated being a wire and the zincate activating step including the immersion of the aluminum wire in a bath at about 105° F and comprising:

| | |
|---|---|
| sodium hydroxide | 120 g/l |
| zinc oxide | 20 g/l |
| sodium cyanide | 5.0 g/l |
| cuprous cyanide | 1.0 g/l |
| nickelous cyanide | 1.0 g/l. |

7. The method described in claim 6 characterized by the final plating being done in an aqueous fluoborate bath including:

| | |
|---|---|
| cupric fluoborate | 440 g/l |
| copper as metal | 117 g/l |
| boric acid | 30 g/l |
| free fluoboric acid | 20 to 30 g/l |

the bath at a specific gravity of 1.29 to 1.33 and a pH of 0.3 to 0.5 (electrometrically) and plating the wire in the fluoborate solution at a temperature of 150° ± 5° F and with a current density of 600 of 750 amp/sq. ft.

8. The method described in claim 1 characterized by electroplating aluminum wire with copper from an alkaline strike bath including copper pyrophosphate.

9. The method described in claim 1 characterized by the aluminum stock being wire and being plated in the second bath to an additional thickness of plating equal to more than 3% of the cross sectional area of the wire.

10. The method described in claim 9 characterized by the wire passing progressively through different baths with continuous motion and portions of the wire being in the different baths at the same time, and the additional thickness of plating added in the second bath being at least 7%.

11. The method described in claim 9 characterized by the plating in the acid bath being done in a copper fluoborate solution.

12. The method described in claim 11 characterized by the plating in the acid bath being done in an aqueous solution including:

| | |
|---|---|
| cupric fluoborate | 440 g/l |
| copper as metal | 117 g/l |
| boric acid | 30 g/l |
| free fluoboric acid | 20 to 30 g/l |

the bath at a specific gravity of 1.29 to 1.33 and a pH of 0.3 to 0.5 (electrometrically) and plating the wire in the fluoborate solution at a temperature of 150° ± 5° F and with a current density of 600 to 750 amp/sq. ft.

13. The method according to claim 1 characterized by at least one of the plating baths being circulated continuously through a filter that removes organic matter from the bath.

14. The method described in claim 13 characterized by the plating bath being circulated continuously through an activated carbon filter.

15. The product of the process of claim 1.

16. The product described in claim 15 characterized by the aluminum stock being an electrical conductor wire and the thicker coating being a plating of copper deposited from an acid bath.

* * * * *